US006218947B1

(12) United States Patent
Sutherland

(10) Patent No.: US 6,218,947 B1
(45) Date of Patent: Apr. 17, 2001

(54) DRIVER SLEEP ALARM

(76) Inventor: Ronald L. Sutherland, 619 E. 8th St., Lawrence, KS (US) 66004

( * ) Notice: Subject to any disclaimer, the term of this patent is extended or adjusted under 35 U.S.C. 154(b) by 0 days.

(21) Appl. No.: 09/578,154

(22) Filed: May 23, 2000

(51) Int. Cl.[7] ..... G08B 23/00

(52) U.S. Cl. ..... 340/576; 340/439; 340/545.4; 340/575; 180/272

(58) Field of Search ..... 340/575, 576, 340/425.5, 439, 545.4; 180/272; 324/658, 686

(56) References Cited

U.S. PATENT DOCUMENTS

| | | | | |
|---|---|---|---|---|
| 3,585,626 | | 6/1971 | Tartarini | 340/279 |
| 4,091,371 | | 5/1978 | Mason, Jr. et al. | 340/274 R |
| 4,210,905 | | 7/1980 | Coons | 340/575 |
| 4,259,665 | | 3/1981 | Manning | 340/575 |
| 4,485,375 | | 11/1984 | Hershberger | 340/576 |
| 4,496,938 | | 1/1985 | Seko et al. | 340/576 |
| 4,540,979 | | 9/1985 | Gerger et al. | 340/576 |
| 5,453,929 | * | 9/1995 | Stove | 364/424.01 |
| 5,463,258 | | 10/1995 | Fillion et al. | 307/10.1 |
| 5,585,785 | | 12/1996 | Gwin et al. | 340/575 |
| 5,594,222 | | 1/1997 | Caldwell | 200/600 |
| 5,691,693 | * | 11/1997 | Kithil | 340/439 |
| 5,722,686 | * | 3/1998 | Blackburn et al. | 280/735 |
| 5,933,102 | | 8/1999 | Miller et al. | 341/33 |
| 5,969,616 | | 10/1999 | Tschoi | 340/576 |
| 5,990,795 | * | 11/1999 | Miller | 340/576 |

* cited by examiner

*Primary Examiner*—Jeffery Hofsass
*Assistant Examiner*—Phung T. Nguyen
(74) *Attorney, Agent, or Firm*—Dale J. Ream

(57) ABSTRACT

A sleep alarm for use in a vehicle for detecting the condition indicative of the onset of sleepiness of a driver and for alerting the driver thereto comprises first and second conductive elements attached in spaced apart relationship to opposite sides of a steering wheel rim. The first conductive element is electrically grounded while the second conductive element is connected to a voltage source. The conductive elements are positioned such that the fingertips of a driver's hand will make proximate contact with the second conductive element. A monitoring circuit is electrically coupled to the second conductive element for sensing the capacitance of the second conductive element relative to the first grounded conductive element. The driver sleep alarm further includes a comparator for comparing the sensed capacitance with a reference capacitance and for activating an alarm if the comparison indicates a decrease in capacitance caused by a release of the driver's fingertips from the steering wheel rim proximate the second conductive element.

19 Claims, 4 Drawing Sheets

DRIVER SLEEP ALARM

BACKGROUND OF THE INVENTION

This invention relates generally to safety devices and, more particularly, to a driver sleep alarm for use in a vehicle which detects the condition of sleepiness or inattentive driving and alerts the driver thereof.

The reality of drivers becoming increasingly drowsy or even falling asleep while driving is a grave problem which carries well-publicized consequences. Even a momentary lapse in mental alertness and attentiveness often leads to the long-lasting disability or even death of the drowsy driver or to others. In addition, the grisly statistics of vehicular accidents resulting from drowsy drivers or drivers lacking adequate alertness due to drug or alcohol consumption do not reflect the mental anguish and sorrow suffered by the family and friends of persons needlessly injured or killed.

Many devices have been proposed in the art for alerting drivers of the condition of drowsiness. Many of these devices may be categorized as pressure responsive or grip-sensitive devices. Maintaining sufficient pressure on a steering wheel or other grip-sensitive structure for long periods of time, however, may lead to even further driver fatigue. In addition, implementation of pressure sensing transducers is complex and expensive, especially those which are adaptable to the pressure exerted by different drivers of a single vehicle.

Other systems, such as the alarm disclosed in U.S. Pat. No. 4,259,665, utilize a pair of conductive plates spaced apart about a steering wheel between which a current is communicated through the hand of the driver when placed in contact therewith. It has been found, however, that such a system is prone to electrical shorting from condensation on the steering wheel. Another problem is dry contact resistance wherein current is not delivered between the plates because a person's skin is very dry or the driver is wearing gloves. Still another problem with conductive systems is that the plates may become soiled and thus unable to consistently deliver current therebetween.

Another category of sleep alarms includes optical devices which must be worn about a driver's head or neck. These devices also contribute to driver fatigue as the driver holds his head rigidly so as to avoid inadvertently tripping the alarm. Other optical systems are mounted on the steering wheel itself and use optical beam deflection to monitor finger placement. These systems, however, require a protrusion on the back of the steering wheel for the light beam-shaping lens and require a driver's fingers to extend through the protrusions in an uncomfortable and unfamiliar manner.

Many sleep alarms from each of the above described categories include manual disabling switches whereby a driver may completely deactivate the device. Unfortunately, the complexity or disadvantages of these system often leads to such deactivation and non-use by drivers.

Therefore, it is desirable to have a driver sleep alarm which overcomes the above described disadvantages by sensing the position of a driver's fingertips on, or in close proximity to, a steering wheel without requiring any level of grip pressure, circuit formation, or optical sensing. Further, it is desirable to have a driver sleep alarm which operates effectively even when a driver is wearing gloves. In addition, it is desirable to have a driver sleep alarm which is not affected by humidity, condensation, light, or other environmental conditions. Finally, it is desirable to have a driver sleep alarm which may only be temporarily disabled by a driver.

SUMMARY OF THE INVENTION

The preferred embodiment of the present invention comprises a pair of conductive plates attached to opposed sides of a steering wheel rim in a spaced apart arrangement. The first conductive plate is attached to the front side of the steering wheel rim and is electrically grounded. The second conductive plate is attached to the back side of the rim.

A monitoring circuit is electrically connected to the second conductive plate for sensing the capacitance of the second conductive plate relative to the first conductive plate. The capacitance thereof corresponds to a touching, or near touching, of the steering wheel at the approximate position of the second conductive plate by the fingertips of the driver. The monitoring circuit provides a voltage to the second plate for charging the second plate and for measuring the capacitance thereof relative to the first grounded plate. The monitoring circuit is connected to a voltage source such as the vehicle battery and includes a clock element and a pair of monostable multi-vibrators, also known as "one-shots", which are initiated by the rising edge of a clock pulse (P1). A first one-shot is connected to the second plate and measures the capacitance thereof. A proximate touching of the second plate affects the capacitance thereof and, thus, the speed at which that plate is charged. The first one-shot generates a pulse (P2) having a width representing the speed with which the second plate is charged. The second one-shot operates as a reference and therefore generates a reference pulse (P3) having substantially the same width during every clock cycle. The pulse width of the reference one-shot is adjustable, thus affecting the "sensitivity" of the steering wheel to a driver's hand. At its most sensitive setting, a driver need not even physically touch the steering wheel to successfully make "proximate" contact therewith. Therefore, this invention effectively establishes an "electric field" about the steering wheel to monitor the position of a driver's fingertips thereabout.

A D-type flip-flop is used to compare the width of pulse P2 and P3. The pulse (P2) generated by the first one-shot is delivered to the data pin of a D-type flip-flop or comparator. The clock pulse (P3) is delivered to the clock input pin of the flip-flop. The data pin is read only upon receipt of a downward edge of a clock pulse. In the case where the second plate has been charged before the downward transition of the clock pulse (P3), then the pulse (P2) will have a width less than that of the clock pulse (P3) and will therefore register a "low" or "0" into the flip-flop. This is indicative of a removal or release of a driver's fingertips from the back side of the steering wheel and an alarm is activated. Conversely, if the second plate is still charging and thus is still registering a "high" pulse when a downward edge of a clock pulse (P3) is received by the flip-flop, a "high" or "1" is registered in the flip-flop. This is indicative of the driver's fingertips touching the steering wheel rim at the proximate location of the second conductive plate and the alarm is disabled.

A touching, or near touching depending on the capacitive sensitivity, of the steering wheel rim proximate to the second plate affects capacitance because capacitance is directly proportional to the surface area of the plates and inversely proportional to the distance between the plates. Therefore, capacitance increases as a person's finger, which has ground potential, is moved closer to the second plate. Sensing capacitance of a plate positioned on the back side of the steering wheel rim is extremely advantageous in that an uncurling of a user's fingertips from about the rim is indicative of drowsiness or inattentiveness.

The preferred embodiment of this invention may include a speed sensor adapted to disable the alarm when the vehicle is traveling at a rate less than a predetermined speed. The invention may also include a noise sensor for sensing engine, radio, or other ambient noise so as to automatically adjust the volume of the alarm or to reduce the volume of one or more of the engine noises upon alarm activation. The alarm may also be disabled by the driver for selectable amounts of time.

Therefore, a general object of this invention is to provide a driver sleep alarm which continually monitors placement of a driver's fingertips on or about a steering wheel by sensing changes in the capacitance of capacitive sensitive elements arranged thereon.

Another object of this invention is to provide a driver sleep alarm, as aforesaid, which activates an audible alarm upon sensing a decrease in capacitance indicative of a removal of a driver's fingers from the back side of the steering wheel rim.

Still another object of this invention is to provide a driver sleep alarm, as aforesaid, which disables or deactivates the alarm upon sensing a capacitance greater than a reference voltage indicative of a driver's fingers being encircled about the steering wheel rim.

A further object of this invention is to provide a driver sleep alarm, as aforesaid, which disables the alarm when the vehicle is traveling at a speed that is less than a predetermined speed.

A still further object of this invention is to provide a driver sleep alarm, as aforesaid, in which the alarm may be temporarily disabled by a driver for selectable periods of time.

Yet another object of this invention is to provide a driver sleep alarm, as aforesaid, which ensures that the volume of the alarm is louder than any vehicle noise.

A further object of this invention is to provide a driver sleep alarm, as aforesaid, which only monitors that portion of the steering wheel rim where a driver's fingertips should be during normal operation.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A driver sleep alarm 10 according to a preferred embodiment of the present invention will now be described with reference to FIGS. 1–5.

Figure 1:
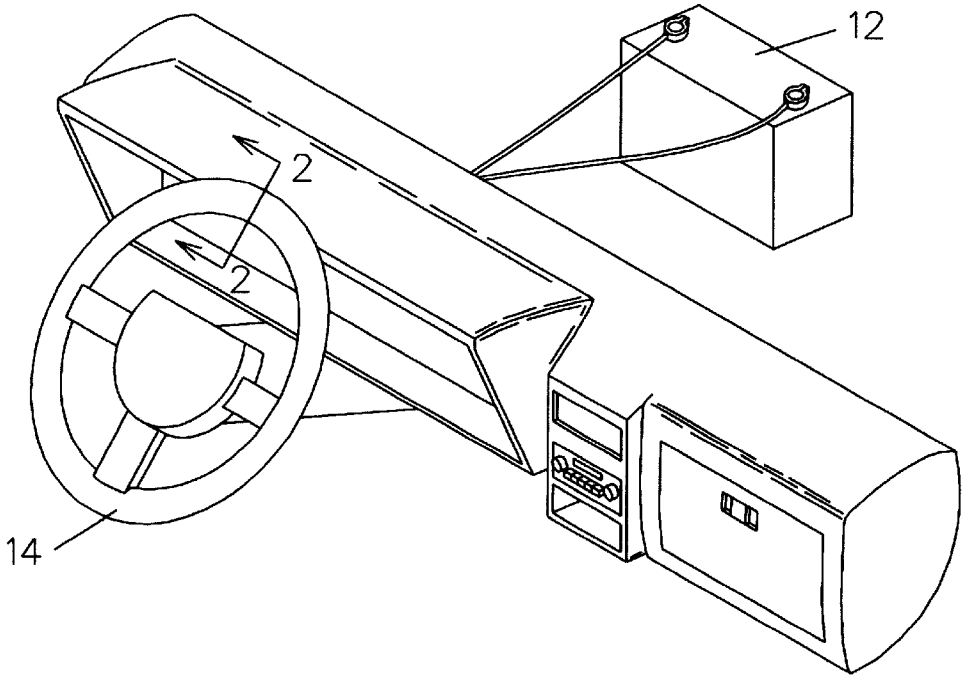
FIG. 1 is a perspective view of the interior of a vehicle with a preferred embodiment of the driver sleep alarm in use thereon.
Figure 2:
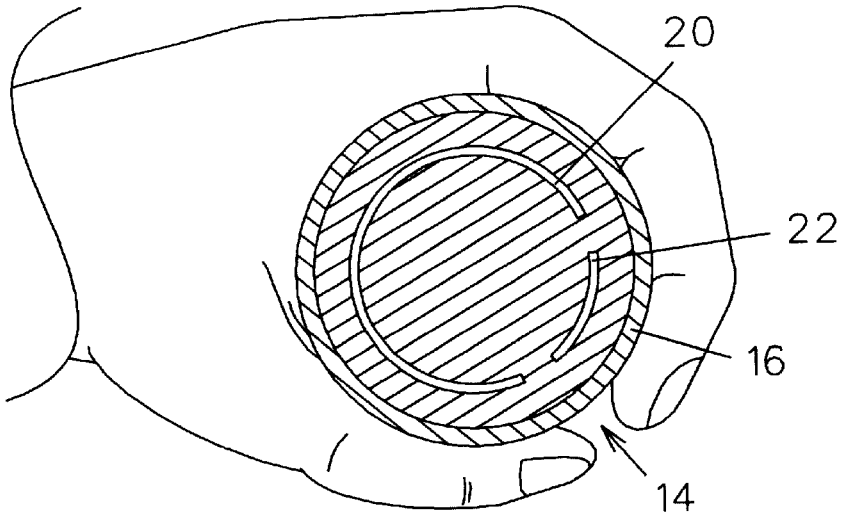
FIG. 2 is a sectional view of the steering wheel rim taken along line 2—2 of FIG. 1 with a driver's finger encircled thereabout.

The driver sleep alarm 10 may be mounted to a steering wheel rim 14 for use in a vehicle such as a car or even a semitruck. The driver sleep alarm 10 is powered by connection to the vehicle battery 12 (FIG. 1). The driver sleep alarm 10 includes a first conductive plate 20 attached to a front or forward portion of the steering wheel rim 14 and extends substantially radially thereabout (FIG. 2). However, the first plate 20 does not cover the rearward-most portion of the rim 14. The first plate 20 is electrically grounded. A second conductive plate 22 is attached to a back or rearward portion of the steering wheel rim 14. The first 20 and second 22 plates are spaced apart from one another and extend along the entire circumference of the steering wheel rim 14. Preferably, the plates are braided wire, although sheet metal or conductive plastic plates would also be suitable. The first plate 20 acts as a ground shield so that the proximity of a driver's hand to the front portion of the steering wheel rim 14 is not detected, as to be further described below.

The material in the space between the plates 20, 22 forms a dielectric or insulation therebetween. Further, the plates may be imbedded and sealed within the steering wheel rim 14 itself and insulated from the conventional steel core thereof which must also be grounded. In addition, the steering wheel rim 14 is encircled with a steering wheel cover 16 constructed of plastic or fiberglass which overlays the plates 20, 22 and further constitutes a dielectric relative thereto (FIG. 2). Therefore, the proximity sensing elements are hidden from view and protected from environmental elements.

Figure 3:
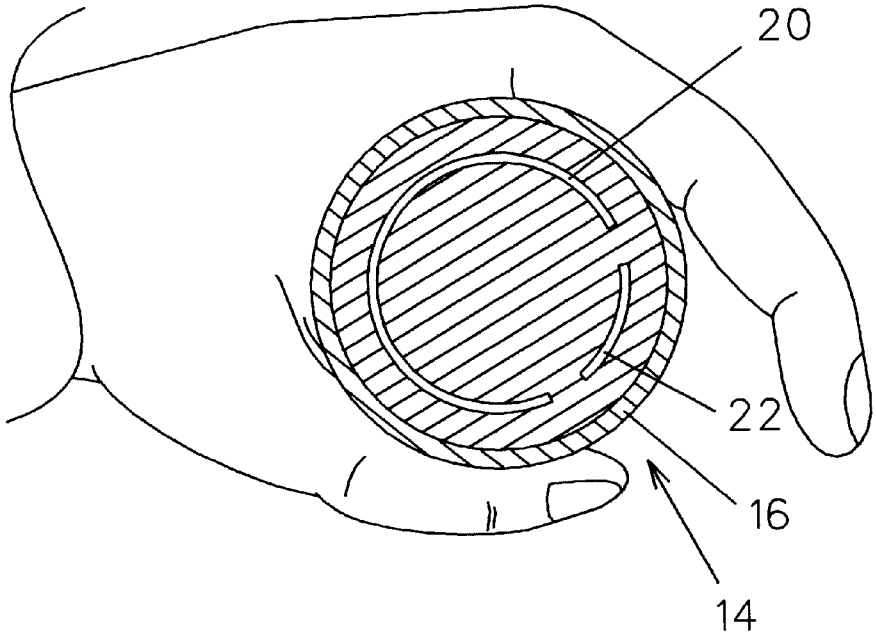
FIG. 3 is a sectional view as in FIG. 2 with a driver's finger being released from the steering wheel rim.

A measurable electric field is created within the dielectric between the plates 20, 22 when a voltage is applied to the second plate 22. Further, the capacitance of the second plate 22 is increased by a driver's fingertips touching the rear of the steering wheel rim 14 proximate the second plate 22 (FIG. 2) as this effectively increases the surface area of the plates and decreases the distance between the plates. Conversely, capacitance is decreased when a driver's fingertips are removed from proximate contact with the second plate 22 (FIG. 3). These results follow from the basic rule that capacitance is directly proportional to the surface areas of the plates and inversely proportional to the distance between the plates.

Figure 4:
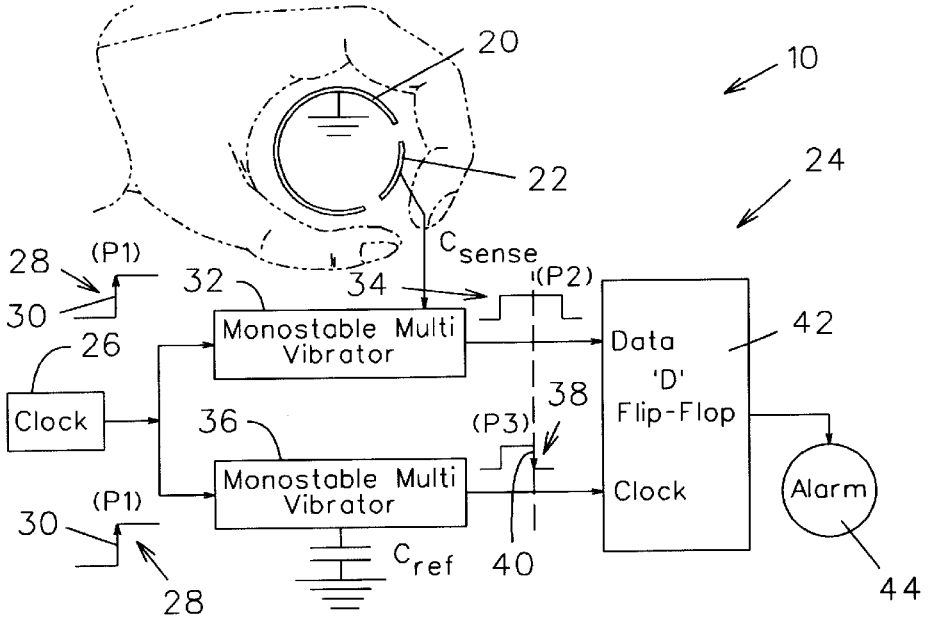
FIG. 4 is a schematic view of the monitoring circuit connected to a second conductive plate with a driver's finger encircled about a steering wheel rim being shown in phantom lines.
Figure 5:
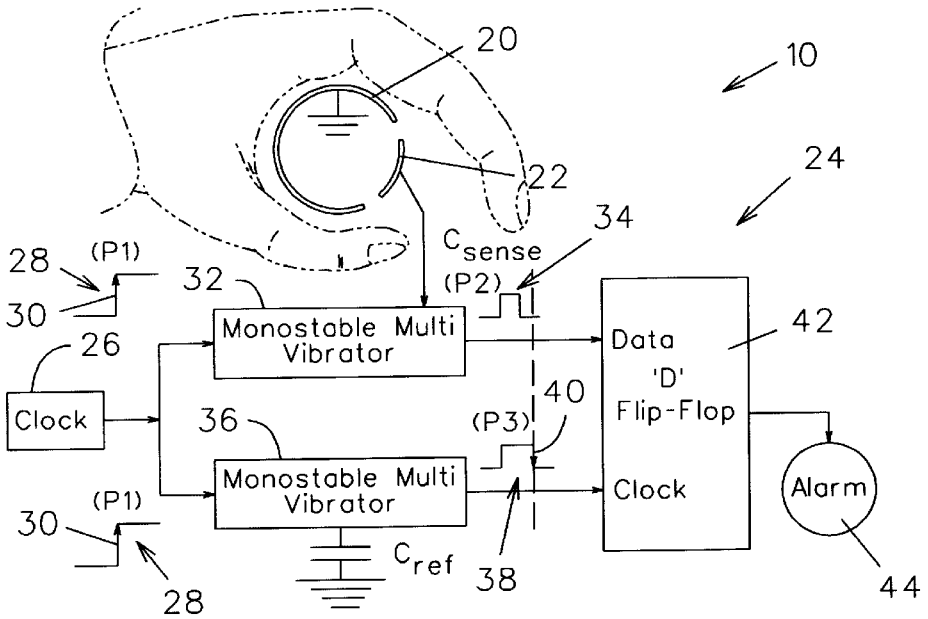
FIG. 5 is a schematic view of the monitoring circuit connected to the second conductive plate with a driver's finger released from a steering wheel rim being shown in phantom lines.

A monitoring circuit 24 is electrically connected to the vehicle battery 12 or other power source. The monitoring circuit 24 includes a clock 26 which is connected to first 32 and second 36 monostable multi-vibrators, also known as "one-shots" (FIGS. 4 and 5). Both one-shots are simultaneously triggered by the rising edge 30 of a clock pulse (P1) 28. The first one-shot 32 is connected to the second plate 22 and delivers a voltage thereto for charging the second plate 22. The first one-shot 32 senses the capacitance of the second plate 22. The first one-shot 32 generates a pulse (P2) 34 representative of this charge/discharge time relationship. This pulse (P2) remains at a high state while the second plate 22 is charging and transitions to a low state upon reaching a reference charge. Therefore, the width of the high state of this pulse (P2) 34 corresponds to the time duration of the charge event. The output pulse width of the second one-shot 36, however, is established by a reference capacitance and therefore generates a reference pulse (P3) 38 having a high state width that is substantially the same for every clock cycle.

The monitoring circuit 24 includes a negative edge D-type flip-flop 42 connected to the one-shots. The sensed capacitance pulse (P2) 34 is delivered to the data pin of the flip-flop 42 whereas the reference capacitance or clock pulse (P3) 38 is delivered to the clock pin thereof. The data pin reads the sensed capacitance pulse (P2) 34 only upon receipt of a falling edge 40 of the clock pulse (P3) 38, i.e. the transition of the pulse (P3) from a high to low state. If upon receipt of a falling edge 40 of the clock pulse (P3) 38 the second plate 22 is still charging, a high state or "1" is registered in the flip-flop and an audible alarm 44 coupled to the flip-flop 42 will not be activated thereby. This state is indicative that the sensed capacitance is greater than the reference capacitance and, more particularly, that the driver's fingertips are touching the steering wheel rim 14 proximate to the second plate 22 (FIG. 4). Conversely, if upon receipt of a falling edge 40 of the clock pulse (P3) 38 the second plate 22 has already been charged, a low state or "0" will be registered in the flip-flop 42 and the alarm 44 will be activated. This state is indicative that the sensed capacitance is less than the reference capacitance and, more particularly, that the fingertips of a driver have been released from contact with the steering wheel rim 14 proximate the second plate 22 (FIG. 5).

It should be appreciated that use of the grounded first plate 20 is preferred in that it best facilitates the sensing of capacitance changes although it is not essential. The ground potential of a driver's body is sufficient to establish sufficient capacitance whereby to disable the alarm 44 upon proximate contact between a driver's hand or fingertips and the second plate 22. The steering wheel cover 16 acts as a dielectric between plate 22 and a driver's fingertips or hand in this case.

It is understood that the monitoring circuit 24 and alarm 44 may be mounted on the steering element itself or mounted to the dashboard and electrically connected to the plates. However, in aftermarket applications, direct wiring may not be practical and other methods such as capacitive linking, inductive linking, electromagnetic linking, wireless or optical transmission would also be suitable. The plates may be positioned within an aftermarket cover as well.

In use, a driver is required to maintain continual contact with the back portion of the steering wheel with at least one finger to avoid activation of the audible alarm. In practice, this will obligate the driver to keep at least one hand on the steering wheel with the fingers curled thereabout in good driving position. However, no particular grip pressure is required nor is specific finger position necessary to form a circuit. So long as a driver's fingertips are proximately placed over the second plate 22, the sensed capacitance of the second plate 22 will exceed that of the reference capacitance so as not to activate the alarm 44. However, a release of the fingertips from about the steering wheel rim 14 will result in a decrease in capacitance and the alarm 44 will be activated. Returning the fingertips to proximate contact with the second plate 22 immediately squelches the alarm 44.

It is understood that the capacitive sensitivity may be adjusted by modifying the reference capacitance of the second one-shot. Accordingly, the audible alarm may remain disabled upon a driver's fingertips merely being placed within a predetermined proximity to the back of the steering wheel rim. In essence, this invention monitors the effect of the position of a driver's fingertips about the steering wheel upon an "electric field" thereabout.

Although the driver sleep alarm 10 does not include a long-term alarm disabling switch, another embodiment thereof includes a switch for disabling the alarm 44 for a short time as selected by the driver. For example, a press of a button may cause a one minute disabling of the alarm 44. The circuit could also be modified to sense a tapping of the steering wheel rim 14 proximate the second plate 22 so as to disable the alarm 44 for a predetermined period of time per tap, with a predetermined maximum time.

Another embodiment of the driver sleep alarm 10 includes a speed sensor which disables the alarm 44 when the vehicle is moving at a rate less than a predetermined rate of speed. This function eliminates nuisance alarms during city driving or when the vehicle is parked. Sensing vehicle speed may be by using existing tachometer pulses to the speedometer or other known sensors.

Still another embodiment of the driver sleep alarm includes a volume sensor which senses the volume of engine noise, radio/stereo sound, ambient sound, etc. and generates a signal to increase or decrease the volume of the alarm 44 accordingly. This embodiment ensures that the alarm 44 is heard over ambient noise while not being excessively loud during occasional lapses in the driver's attention. Alarm volume may also be linked to vehicle speed. Once the alarm is activated, however, its volume is maintained even if vehicle speed or ambient noise is decreased. It should also be appreciated that the audible alarm may be integrated into the vehicle's radio/stereo system such that the music would be muted and the alarm signal substituted therefore when appropriate. Therefore, this invention may be implemented as a subsystem of a Local Interconnect Network (LIN) so as to be interfaced with vehicle speed, instruments, radio/stereo, etc.

A more advanced embodiment of this invention includes a circuit having a memory and adapted to log the time or frequency of alarm activation so as to allow a third party, such as an employer, to review the attentiveness of its driver/employees. As it is recognized that all of the embodiments of the driver sleep alarm may be subverted by wrapping the steering wheel rim with a conductive element such as aluminum foil, this embodiment divides the steering wheel rim into sectors each with its own proximity sensing elements for sensing occasional movement of the driver's hand.

Accordingly, the driver sleep alarm monitors the proximity of a driver's fingers to the back of a steering wheel rim in an aesthetic and unobtrusive manner and without requiring any particular gripping pressure.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A driver sleep alarm for a vehicle for detecting the onset of sleepiness or inattentive driving of a driver, comprising:

a first capacitive sensitive element adapted to be positioned on a vehicle steering element;

a second capacitive sensitive element adapted to be positioned on said vehicle steering element spaced apart from said first capacitive sensitive element;

a monitoring circuit electrically connected to said second capacitive sensitive element for measuring the capacitance thereof corresponding to touching of said steering element proximate said second capacitive sensitive element by a hand of the driver;

an alarm; and means connected to said monitoring circuit for activating said alarm upon a decrease in capacitance measured by said monitoring circuit indicative of a release of a driver's hand from proximate contact with said second capacitive sensitive element, said activating means deactivating said alarm upon an increase in capacitance measured by said monitoring circuit indicative of touching of said steering element proximate said second capacitive sensitive element by a hand of the driver.

2. A driver sleep alarm as in claim 1 wherein said monitoring circuit is electrically connected to a voltage source for charging said capacitive sensitive element connected to said monitoring circuit.

3. A driver sleep alarm as in claim 2 wherein said alarm is an audible alarm having a variable volume that is proportionately louder than a sensed level of vehicle noise.

4. A driver sleep alarm as in claim 2 further comprising means for temporarily disabling said alarm for a selectable time duration.

5. A driver sleep alarm as in claim 2 further comprising means for automatically disabling said alarm when the vehicle is moving at a speed less than a predetermined speed.

6. A driver sleep alarm as in claim 1 further comprising a steering wheel cover mounted to said steering element, said cover overlaying said capacitive sensitive element and forming a dielectric between said capacitive sensitive element and the hand of a driver.

7. A driver sleep alarm for use in a vehicle for detecting a condition indicative of the onset of sleepiness or inattentive driving and for alerting a driver thereto, comprising:

a first conductive element adapted to be attached to a front side of a steering wheel rim;

a second conductive element adapted to be attached to a back side of said steering wheel rim, said second conductive element being spaced from said first conductive element and positioned for proximate contact with the fingertips of a driver's hand encircled about said steering wheel rim, said second conductive element connected to a voltage source for charging said second conductive element;

a monitoring circuit electrically connected to said second conductive element for sensing capacitance corresponding to proximate touching of said second conductive element by the fingertips of the driver's hand;

an alarm; and a comparator connected to said monitoring circuit for activating said alarm when said sensed capacitance is indicative of a release of the fingertips of the driver's hand from proximate contact with said second conductive element.

8. A driver sleep alarm as in claim 7 further comprising a steering wheel cover mounted to said steering wheel rim, said cover overlaying said first and second conductive elements attached to said steering wheel rim.

9. A driver sleep alarm as in claim 7 wherein said first and second conductive elements are imbedded within an insulated portion of said steering wheel rim.

10. A driver sleep alarm as in claim 7 wherein said first conductive element is electrically grounded.

11. A driver sleep alarm as in claim 7 wherein said activating means automatically deactivates said alarm upon a sensing of an increase in capacitance by said monitoring circuit indicative of a touching of the fingertips of the driver's hand on said steering wheel rim proximate said second conductive element.

12. A driver sleep alarm as in claim 7 wherein said alarm is an audible alarm having a variable volume that is proportionately louder than a sensed level of vehicle noise.

13. A driver sleep alarm as in claim 7 further comprising means for temporarily disabling said alarm for a selectable time duration.

14. A driver sleep alarm as in claim 7 further comprising a speed sensor for detecting the vehicle's speed and generating a signal for disabling said alarm when the vehicle is moving at a speed less than a predetermined speed.

15. A driver sleep alarm for use in a vehicle for detecting a condition indicative of the onset of sleepiness or inattentive driving and for alerting a driver thereto, comprising:

a first grounded electrode adapted to be attached to a front side of a steering wheel rim;

a second electrode adapted to be attached to a back side of said steering wheel rim and connected to a voltage source for charging said second electrode, said second electrode being spaced from said first electrode and positioned for proximate contact with the fingertips of a driver's hand encircled about said steering wheel rim;

means for sensing the capacitance of said second electrode relative to said first electrode, said sensed capacitance corresponding to proximate touching of said second electrode by the fingertips of a driver's hand;

an audible alarm; and a comparator for comparing said sensed capacitance with a reference capacitance, said comparator activating said alarm if said sensed capacitance is less than said reference capacitance indicative of a release of the fingertips of a driver's hand from proximate contact with said second electrode.

16. A driver sleep alarm as in claim 15 wherein said comparator automatically deactivates said alarm upon a sensing of an increase in capacitance by said sensing means indicative of a touching of the fingertips of the driver's hand on said steering wheel rim proximate said second electrode.

17. A driver sleep alarm as in claim 15 further comprising a sound sensor for detecting the sound level within the vehicle; and means for automatically adjusting the volume of said alarm such that said alarm volume is louder than said detected sound level within the vehicle according to a predetermined proportion.

18. A driver sleep alarm as in claim 15 further comprising means for temporarily disabling said alarm for a selectable time duration.

19. A driver sleep alarm as in claim 15 further comprising a speed sensor for detecting the vehicle's speed and generating a signal for disabling said alarm when the vehicle is moving at a speed less than a predetermined speed.

* * * * *